US006439842B1

(12) United States Patent
Toomey et al.

(10) Patent No.: US 6,439,842 B1
(45) Date of Patent: Aug. 27, 2002

(54) GAS TURBINE ENGINE STATOR CASE

(75) Inventors: Myron Daniel Toomey, Marblehead; Brian Ellis Clouse, Saugus; Michael Thomas Hogan, Tewksbury; Craig Robert Jacobson, Lynn, all of MA (US)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 09/715,325

(22) Filed: Nov. 17, 2000

Related U.S. Application Data

(60) Provisional application No. 60/192,829, filed on Mar. 29, 2000.

(51) Int. Cl.[7] ..... F01D 17/12
(52) U.S. Cl. ..... 415/162; 415/214.1
(58) Field of Search ..... 415/154, 160, 415/161, 162, 214.1, 177, 178

(56) References Cited

U.S. PATENT DOCUMENTS

| | | | | |
|---|---|---|---|---|
| 2,622,790 A | * | 12/1952 | McLeod | 415/209.1 |
| 4,264,274 A | | 4/1981 | Benedict | 415/199.5 |
| 4,578,942 A | | 4/1986 | Weller | 60/39.32 |
| 4,893,983 A | | 1/1990 | McGreehan | 415/48 |
| 5,063,661 A | * | 11/1991 | Lindsay | 415/214.1 |
| 5,211,537 A | * | 5/1993 | Langston et al. | 415/209.2 |
| 6,035,929 A | | 3/2000 | Friedel et al. | 165/168 |

* cited by examiner

*Primary Examiner*—Edward K. Look
*Assistant Examiner*—Richard Woo
(74) *Attorney, Agent, or Firm*—Nathan D. Herkamp; Sonnenschein, Nath & Rosenthal

(57) ABSTRACT

A stator case for a gas turbine engine having a stator and a rotor. The rotor has a plurality of circumferential rows of blades. Each blade extends radially outward from a root to a tip. The case includes a tubular shell extending axially between a forward end and an aft end. The shell has an interior surface defining a hollow interior sized and shaped for receiving at least a portion of the rotor of the gas turbine engine. The case also includes a circular forward flange extending radially outward from the forward end of the shell and a circular aft flange extending radially outward from the aft end of the shell. In addition, the case includes a circular rib extending radially outward from the shell between adjacent rows of blades. The rib is sized and shaped for adjusting transient deflections of the shell to generally match transient deflections of the tips of the plurality of rotor blades to reduce a transient clearance between the interior surface of the tubular shell and the tips of the rotor blades.

7 Claims, 3 Drawing Sheets

GAS TURBINE ENGINE STATOR CASE

CROSS-REFERENCE TO RELATED APPLICATION

This application claims priority from U.S. Provisional Patent Application Ser. No. 60/192,829 filed Mar. 29, 2000, which is hereby incorporated by reference.

BACKGROUND OF THE INVENTION

The present invention relates generally to a gas turbine engine stator case and more particularly, to a stator case having transient deflections matched to a rotor of the engine.

Gas turbine engines have a stator and one or more rotors rotatably mounted on the stator. The rotors have blades arranged in circumferential rows. Each of the blades extends outward from a root to a tip. The stator is formed from one or more tubular cases which house the rotor such that the rotor blades rotate within the cases. In the compressor section of gas turbine engines, it is desirable to minimize clearances between the blade tips and interior surfaces of the cases to improve engine stall margins and efficiencies. In the turbine section of gas turbine engines, it is desirable to minimize clearances between the blade tips and interior surfaces of the cases to improve engine efficiency.

The clearances between the rotor blade tips and the interior surfaces are determined by the deflections of the blade tips and the deflections of the interior surfaces of the stator cases. The deflections of the blade tips are caused by mechanical strain due to centrifugal forces on the spinning rotor and thermal growth due to elevated flowpath gas temperatures. Likewise, the deflections of the interior surfaces of the cases are a function of mechanical strain and thermal growth. These deflections may be adjusted by controlling mechanical strain and thermal growth of the rotors and stator cases. In general, it is desirable to adjust the deflections so the clearances between the rotor blade tips and the interior surfaces of the stator cases are minimized, particularly during steady state engine operation.

In the past, the stator case deflection has been primarily controlled by directing cooling air to portions of the case to reduce deflections thereby reducing clearances between the blade tips and the interior surfaces of the cases. Alternatively, circumferential ribs were formed in the case directly above the blade tips to reduce stator deflections. However, there is a need to reduce clearances further to improve stall margins and efficiencies of gas turbine engines.

SUMMARY OF THE INVENTION

Among the several features of the present invention may be noted the provision of a stator case for a gas turbine engine having a stator and a rotor. The rotor has a plurality of circumferential rows of blades. Each blade extends radially outward from a root to a tip. The case includes a tubular shell extending axially between a forward end and an aft end. The shell has an interior surface defining a hollow interior sized and shaped for receiving at least a portion of the rotor of the gas turbine engine. The case also includes a circular forward flange extending radially outward from the forward end of the shell and a circular aft flange extending radially outward from the aft end of the shell. In addition, the case includes a circular rib extending radially outward from the shell between adjacent rows of blades. The rib is sized and shaped for adjusting transient deflections of the shell to generally match transient deflections of the tips of the plurality of rotor blades to reduce a transient clearance between the interior surface of the tubular shell and the tips of the rotor blades.

In another aspect, the present invention includes a gas turbine engine comprising a stator and a rotor rotatably mounted on the stator. The stator includes a case as described above.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
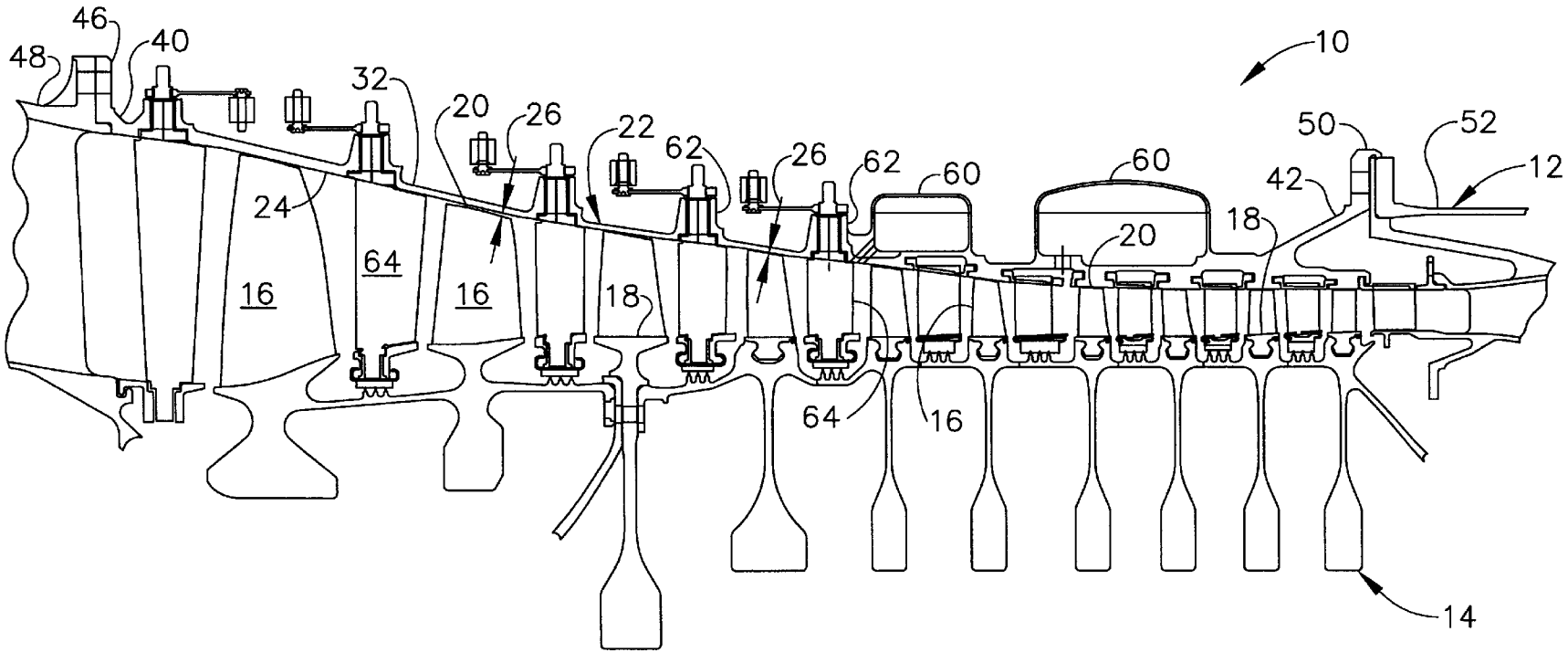
FIG. 1 (PRIOR ART)
FIG. 1 is a vertical cross section of a portion of a prior art gas turbine engine.

Referring now to the drawings and in particular to FIG. 1, a gas turbine engine (partially shown) is designated in its entirety by the reference number 10. The engine 10 has a stator (generally designated by 12) and one or more rotors (generally designated by 14) rotatably mounted on the stator. Although FIG. 1 illustrates the stator and rotor of a high pressure compressor, those skilled in the art will appreciate that the present invention may also be applied to other portions of the engine such as a turbine. The rotor 14 has blades 16 arranged in circumferential rows. Each of the blades 16 extends outward from a root 18 to a tip 20. The stator 12 comprises a tubular case, generally designated by 22, having an interior surface 24 which surrounds the blade tips 20. As will be appreciated by those skilled in the art, it is desirable to minimize clearances 26 between the blade tips 20 and the interior surface 24 of the case 22.

Figure 2:
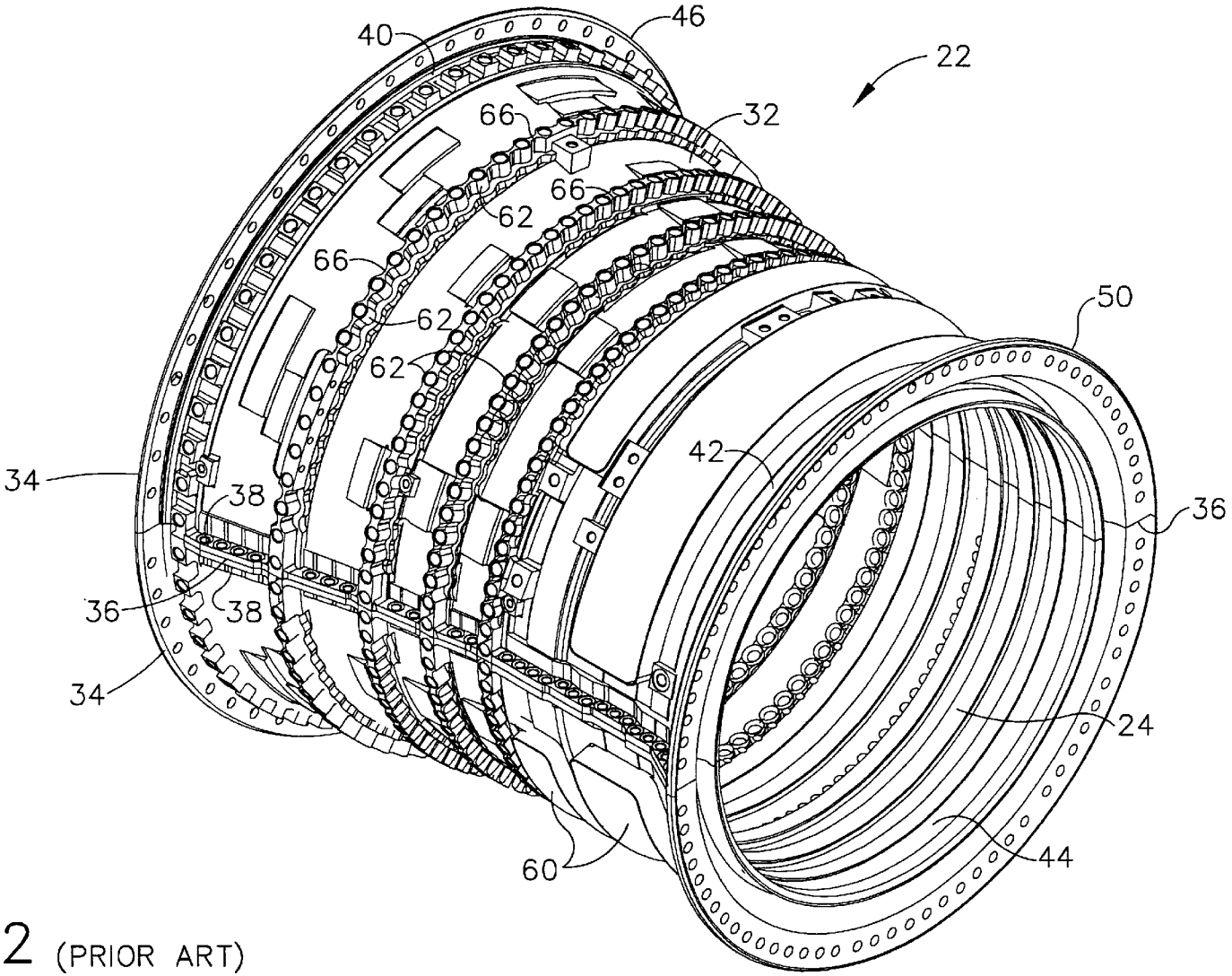
FIG. 2 (PRIOR ART)
FIG. 2 is a perspective of a prior art compressor case.

In order to better illustrate the differences between the stator case of the present invention, generally designated by 30 (FIG. 3), and stator cases in the prior art, a prior art stator case 22 will be described in further detail with reference to FIG. 2. The prior art case 22 includes a tubular shell 32 formed from two case halves 34 joined at axial parting lines 36. Each case half 34 has a flange 38 extending axially along its respective sides for joining the halves with fasteners (not shown). The shell 32 extends axially between a forward end 40 and an aft end 42 opposite the forward end. Further, the interior surface 24 of the shell 32 defines a hollow interior, generally designated by 44, sized and shaped for receiving at least a portion of the rotor 14 (FIG. 1) of the gas turbine engine 10. A circular forward flange 46 extends radially outward from the forward end 40 of the shell 32 for connecting the case 22 to a first stator component 48 (FIG. 1) positioned in front of the shell. Likewise, a circular aft flange 50 extends radially outward from the aft end 42 of the shell 32 for connecting the case 22 to a second stator component 52 (FIG. 1) positioned behind the shell. Manifolds 60 are provided toward the aft end 42 of the case 22 for directing pressurized air withdrawn from the flowpath to other portions of the engine 10. Further, circumferential rows of cylindrical bosses 62 extend outward from the shell 32 for holding variable pitch stator vanes 64 (FIG. 1) inside the interior surface 24 of the shell between adjacent rows of blades 16. Each row of bosses 62 is positioned directly outward from a corresponding row of variable pitch stator vanes 64. Further, the bosses 62 are joined by webs 66 (FIG. 2) to support the bosses and for manufacturing convenience. In the past, the widths of the webs 66 have been minimized to reduce engine weight. Other features of the stator 12 are conventional and will not be described in further detail.

Figure 3:
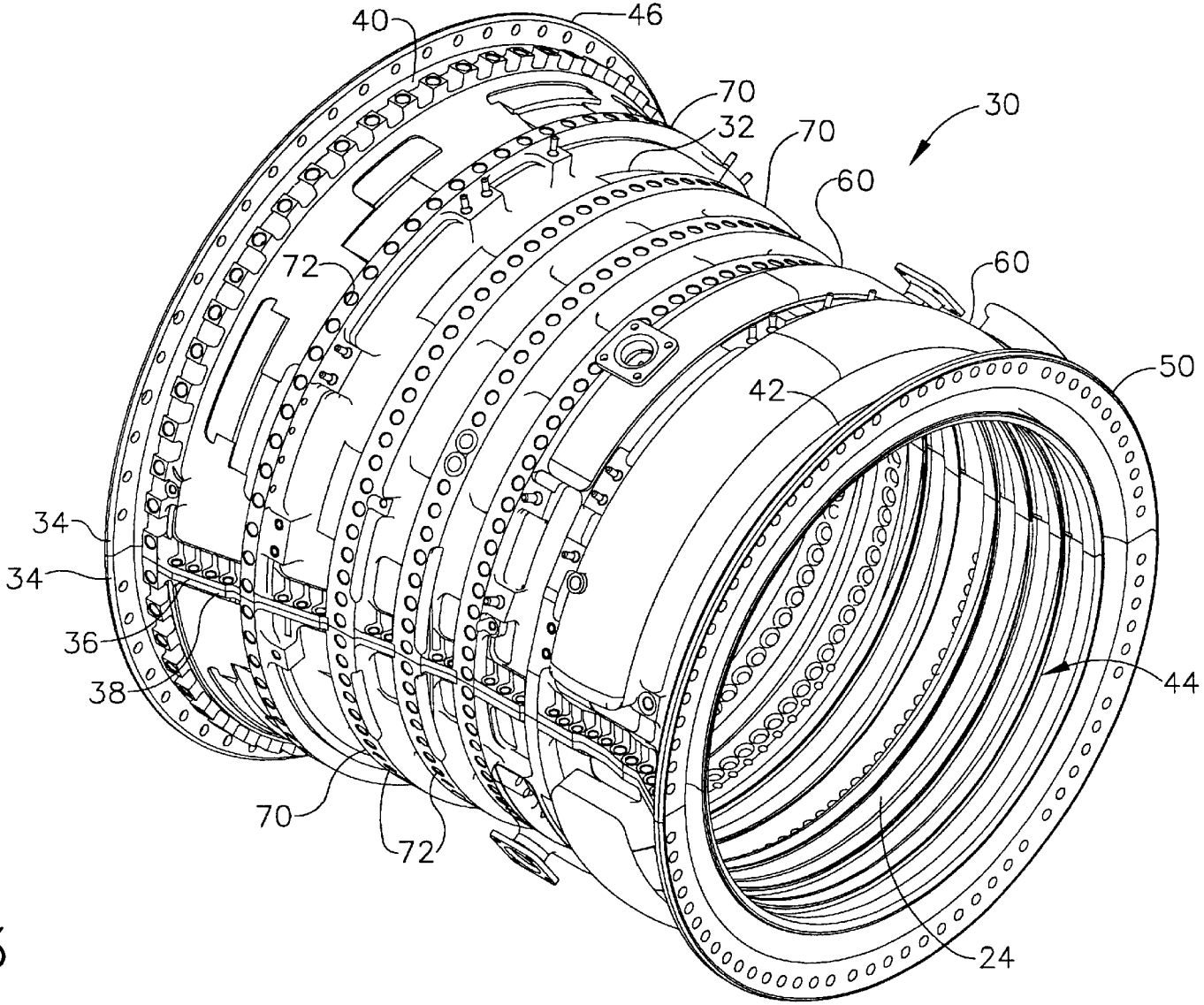
FIG. 3 is a perspective of a compressor case of the present invention.

FIG. 3 illustrates a stator case 30 of the present invention. The stator case 30 is identical to the prior art stator case 22 described above except that circular ribs 70 extend radially outward from the shell 32 instead of the bosses 62 and webs 66. As with the bosses 62 and webs 66, the ribs 70 are positioned between adjacent rows of rotor blades 16. Further, the ribs 70 are positioned radially outward from each row of variable stator vanes 64 (FIG. 1). At this position, the ribs 70 are shielded from hot flowpath gases by outer platforms (not shown) of the vanes 64. Some prior art compressor cases (not shown) also have ribs but they are positioned above the blade tips rather than between them. The case 22 of the present invention has smaller thermal deflections due to heating from flowpath gases than prior art ribbed cases because the ribs 70 of the present invention are thermally shielded from the flowpath gases by the vane outer platforms. Because the ribs 70 are thermally shielded, a smaller surface area of the ribs is exposed to the heated flowpath gases, and less thermal energy is transferred to the ribs. As further illustrated in FIG. 3, the ribs 70 have a series of holes 72 extending radially through the ribs at constant angular intervals around the ribs for mounting the variable stator vanes 64 on the shell 32.

The ribs 70 have a radially and axially extending cross section sized and shaped for adjusting transient deflections of the shell 32 to generally match transient deflections of the tips 20 of the rotor blades 16. As will be appreciated by those skilled in the art increasing the rib cross section, decreases mechanical strain and slows thermal response of the shell 32. By matching the deflections of the shell 32 to the deflections of the blade tips 20, the transient clearances 26 between the interior surface 24 of the tubular shell 32 and the tips 20 of the rotor blades 16 are reduced. More preferably, the ribs 70 are sized and shaped for minimizing the transient clearances 26 between the interior surface 24 of the tubular shell 32 and the tips 20 of the rotor blades 16. Further, the ribs 70 are sized and shaped to adjust shell 32 deflections to reduce non-circularity of the interior surface 24 of the shell. The non-circularity is a result of the axial flanges 36 being stiffer and less affected by mechanical and thermal loading than the other portions of the shell 32. As will be appreciated by those skilled in the art, the size and shape of the ribs 70 needed to reduce and/or minimize clearances and to reduce non-circularity will vary depending on the particular configuration and operating conditions of the engine. However, determining the size and shape of the ribs 70 may be accomplished using conventional and well understood engineering procedures.

Although the present invention has been described with respect to a compressor case, those skilled in the art will appreciate that ribs may also be added to turbine cases to reduce and/or minimize clearances. In addition to increasing stall margin of compressors, replacing the boss and web structure of conventional compressors with ribs having invariant rectangular cross sections reduces cost associated with manufacturing the case 22 by eliminating machining operations.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A stator case for a gas turbine engine having a stator and a rotor rotatably mounted on the stator, the rotor having a plurality of circumferential rows of blades, each of said blades extending radially outward from a root to a tip, said case comprising:

a tubular shell extending axially between a forward end and an aft end opposite said forward end, the shell having an interior surface defining a hollow interior sized and shaped for receiving at least a portion of the rotor of the gas turbine engine;

a circular forward flange extending radially outward from the forward end of the shell for connecting the case to a first stator component positioned in front of the shell;

a circular aft flange extending radially outward from the aft end of the shell for connecting the case to a second stator component positioned behind the shell; and a continuous circular rib extending radially outward from the shell between adjacent rows of blades of said plurality of rows of blades, the rib having a radially and axially extending cross section sized and shaped for adjusting transient deflections of the shell to generally match transient deflections of the tips of said plurality of rotor blades thereby to reduce a transient clearance between the interior surface of the tubular shell and the tips of said plurality of rotor blades.

2. A stator case as set forth in claim 1 wherein the rib is positioned radially outward from a circumferential row of stator vanes mounted inside the interior surface of the shell between adjacent rows of said plurality of rows of blades.

3. A stator case as set forth in claim 2 wherein the rib is positioned radially outward from a row of variable stator vanes mounted inside the interior surface of the shell between adjacent rows of said plurality of rows of blades.

4. A stator case as set forth in claim 3 wherein the rib includes a series of holes extending radially through the rib at constant angular intervals around the rib for mounting said variable stator vanes on the shell.

5. A stator case as set forth in claim 1 wherein:

said shell comprises two halves joined at axial parting lines, each of said parting lines being defined by mating axial flanges on the halves for joining the halves thereby to form the shell; and the rib is sized and shaped to adjust deflections of the shell to reduce non-circularity of the interior surface of the tubular shell.

6. A stator case as set forth in claim 1 wherein the case is a compressor case.

7. A gas turbine engine comprising a stator and a rotor rotatably mounted on the stator, the rotor having a plurality of circumferential rows of blades, each of said blades extending radially outward from a root to a tip, said stator including a case comprising:

a tubular shell extending axially between a forward end and an aft end opposite said forward end, the shell having an interior surface defining a hollow interior sized and shaped for receiving at least a portion of the rotor of the gas turbine engine;

a circular forward flange extending radially outward from the forward end of the shell for connecting the case to a first stator component positioned in front of the shell;

a circular aft flange extending radially outward from the aft end of the shell for connecting the case to a second stator component positioned behind the shell;

a continuous circular rib extending radially outward from the shell between adjacent rows of blades of said plurality of rows of blades, the rib having a radially and axially extending cross section sized and shaped for adjusting transient deflections of the shell to generally match transient deflections of the tips of said plurality of rotor blades thereby to reduce a transient clearance between the interior surface of the tubular shell and the tips of said plurality of rotor blades.

* * * * *